US005523192A

United States Patent [19]

Blanchet-Fincher

[11] Patent Number: 5,523,192

[45] Date of Patent: Jun. 4, 1996

[54] DONOR ELEMENT AND PROCESS FOR LASER-INDUCED THERMAL TRANSFER

[75] Inventor: Graciela Blanchet-Fincher, Wilmington, Del.

[73] Assignee: E. I. Du Pont de Nemours and Company, Wilmington, Del.

[21] Appl. No.: 510,218

[22] Filed: Aug. 2, 1995

Related U.S. Application Data

[63] Continuation of Ser. No. 268,369, Jun. 30, 1994, abandoned.

[51] Int. Cl.[6] ..... G03C 5/54; G03C 1/94

[52] U.S. Cl. ..... 430/200; 430/201; 430/275.1; 430/276.1; 430/945; 430/964

[58] Field of Search ..... 430/200, 945, 430/201, 275, 276, 964

[56] References Cited

U.S. PATENT DOCUMENTS

| | | | |
|---|---|---|---|
| 4,105,569 | 8/1978 | Crossfield | 252/8.6 |
| 4,347,300 | 8/1982 | Shimazu et al. | 430/156 |
| 4,476,267 | 10/1984 | Barda et al. | 524/265 |
| 4,963,606 | 10/1990 | Schleifstein | 524/180 |
| 4,985,503 | 1/1991 | Bronstert et al. | 525/193 |
| 4,990,580 | 2/1991 | Ishihara et al. | 526/160 |
| 5,156,938 | 10/1992 | Foley et al. | 430/200 |
| 5,162,445 | 11/1992 | Powers et al. | 525/333.4 |
| 5,171,650 | 12/1992 | Ellis et al. | 430/20 |
| 5,212,232 | 5/1993 | Kuramoto et al. | 524/779 |
| 5,238,990 | 8/1993 | Yu et al. | 524/504 |
| 5,308,737 | 5/1994 | Bills et al. | 430/945 |
| 5,378,385 | 1/1995 | Thomas et al. | 252/68 |

FOREIGN PATENT DOCUMENTS

0113167A3 7/1984 European Pat. Off. .

*Primary Examiner*—Charles L. Bowers, Jr.
*Assistant Examiner*—Christopher G. Young

[57] ABSTRACT

A donor element for use in a laser-induced thermal transfer process, said element comprising a support bearing on a first surface thereof, in the order listed: (a) at least one ejection layer comprising a first polymer having a decomposition temperature $T_1$; (b) at least one heating layer; (c) at least one transfer layer comprising a binder and an imageable component, wherein the binder comprises a second polymer having a decomposition temperature $T_2$; wherein $T_2 \geqq (T_1 + 100)$, and further wherein a thermal amplification additive is present in at least one of layers (a) and (c) is described.

20 Claims, No Drawings

DONOR ELEMENT AND PROCESS FOR LASER-INDUCED THERMAL TRANSFER

This is a continuation of application Ser. No. 08/268,369 filed Jun. 30, 1994, now abandoned.

FIELD OF THE INVENTION

This invention relates to a donor element for laser-induced thermal transfer processes. More particularly, it relates to a donor element having thermal amplification additives to provide improved sensitivity.

BACKGROUND OF THE INVENTION

Laser-induced thermal transfer processes are well-known in applications such as color proofing and lithography. Such laser-induced processes include, for example, dye sublimation, dye transfer, melt transfer, and ablative material transfer. These processes have been described in, for example, Baldock, UK Patent 2,083,726; DeBoer, U.S. Pat. No. 4,942,141; Kellogg, U.S. Pat. No. 5,019,549; Evans, U.S. Pat. No. 4,948,776; Foley et al., U.S. Pat. No. 5,156,938; Ellis et al., U.S. Pat. No. 5,171,650; and Koshizuka et al., U.S. Pat. No. 4,643,917.

Laser-induced processes use a laserable assemblage comprising a donor element that contains the imageable component, i.e., the material to be transferred, and a receiver element. The donor element is imagewise exposed by a laser, usually an infrared laser, resulting in transfer of material to the receiver element. The exposure takes place only in a small, selected region of the donor at one time, so that the transfer can be built up one pixel at a time. Computer control produces transfer with high resolution and at high speed.

For the preparation of images for proofing applications, the imageable component is a colorant. For the preparation of lithographic printing plates, the imageable component is an oleophilic material which will receive and transfer ink in printing.

These processes are fast and result in transfer of material with high resolution. However, there is a continuing need for increased sensitivity in these systems such that the exposure time to write or create an image is decreased.

SUMMARY OF THE INVENTION

This invention provides a donor element for use in a laser-induced thermal transfer process, said element comprising a support bearing on a first surface thereof, in the order listed:

(a) at least one ejection layer comprising a first polymer having a decomposition temperature $T_1$;

(b) at least one heating layer;

(c) at least one transfer layer comprising (i) a second polymer having a decomposition temperature $T_2$, and (ii) an imageable component;

wherein $T_2 \geqq (T_1+100)$, and further wherein a thermal amplification additive is present in at least one of layers (a) and (c);

In a second embodiment, this invention concerns a donor element for use in a laser-induced thermal transfer process, said element comprising a support bearing on a first surface thereof, in the order listed:

(a) at least one ejection layer containing a dye absorbing at the laser wavelength; and (b) at least one transfer layer comprising a binder, an imageable component; and a thermal amplification additive.

In another embodiment, this invention concerns a laser-induced thermal transfer process comprising:

(1) imagewise exposing to laser radiation a laserable assemblage comprising:

(A) a donor element having a support bearing on a first surface thereof, in the order listed:

(a) at least one ejection layer comprising a first polymer having a decomposition temperature $T_1$;

(b) at least one heating layer;

(c) at least one transfer layer comprising (i) a second polymer having a decomposition temperature $T_2$ and (ii) an imageable component;

wherein $T_2 \geqq (T_1+100)$, and further wherein a thermal amplification additive is present in at least one of layers (a) and (c);

(B) a receiver element in contact with the first surface of the donor element; and (2) separating the donor element from the receiver element.

In still another embodiment, this invention concerns a laser-induced thermal transfer process comprising:

(1) imagewise exposing to laser radiation a laserable assemblage comprising:

(A) a donor element having a support bearing on a first surface thereof, in the order listed:

(a) at least one ejection layer containing a dye absorbing at the laser wavelength;

(b) at least one transfer layer comprising a binder, an imageable component; and a thermal amplification additive;

(B) a receiver element in contact with the first surface of the donor element; and (2) separating the donor element from the receiver element.

Steps (1)–(2) in both of the processes described above, can be repeated at least once using the same receiver element and a different donor element having an imageable component the same as or different from the first imageable component.

DETAILED DESCRIPTION OF THE INVENTION

This invention concerns donor elements for a laser-induced, thermal transfer process, and processes of use for such elements. The donor element comprises a support bearing two or three types of functional layers. In at least one of the functional layers, a thermal amplification additive is present. The donor element is combined with a receiver element to form a laserable assemblage which is imagewise exposed by a laser to effect transfer of an imageable component from the donor element to the receiver element.

It was found that the addition of a thermal amplification additive to at least one of the functional layers results in improved sensitivity, such that the exposure time needed to form or create an image is decreased.

Donor Element

One donor element of the invention comprises a support, bearing on a first surface thereof: (a) an ejection layer comprising a first polymer; (b) at least one heating layer; and (c) at least one transfer layer comprising a polymeric binder and an imageable component; wherein at least one of layers (a) and (c) further comprises a thermally labile additive. The decomposition temperature of the polymeric binder in the transfer layer is at least 100° C. greater than the decomposition temperature of the polymer in the ejection layer. If a dye absorbing at the laser wavelength is introduced in the ejection layer, the heating layer may be eliminated. Thus, the donor element may be a "two-layer" system containing ejection layer with a dye and transfer layer or a "three-layer" system containing ejection, heating, and transfer layers. By "two-layer" and "three-layer" is meant the number of types of functional layers. It is understood that each type of functional layer may actually be made up of multiple layers.

1. Support

Any dimensionally stable, sheet material can be used as the donor support. When the laserable assemblage is imaged through the donor support, the support should also be capable of transmitting the laser radiation, and not be adversely affected by this radiation. Examples of suitable materials include, for example, polyesters, such as polyethylene terephthalate and polyethylene naphthanate; polyamides; polycarbonates; fluoropolymers; polyacetals; polyolefins; etc. A preferred support material is polyethylene terephthalate film. The donor support typically has a thickness of about 2 to about 250 micrometers, and can have a subbing layer, if desired. A preferred thickness is about 10 to 50 micrometers.

2. Thermal Amplification Additive

The thermal amplification additive is present in either the ejection layer or the transfer layer. It can also be present in both of these layers.

The function of the additive is to amplify the effect of the heat generated in the heating layer and thus to increase sensitivity. The additive should be stable at room temperature. The additive can be (1) a compound which, when heated, decomposes to form gaseous byproduct(s), (2) a dye which absorbs the incident laser radiation, or (3) a compound which undergoes a thermally induced unimolecular rearrangement which is exothermic. Combinations of these types of additives can also be used.

Thermal amplification additives which decompose upon heating include those which decompose to form nitrogen, such as diazo alkyls, diazonium salts, and azido ($—N_3$) compounds; ammonium salts; oxides which decompose to form oxygen; carbonates; peroxides. Mixtures of additives can also be used. Preferred thermal amplification additives of this type are diazo compounds such as 4-diazo-N, N'diethylaniline fluoroborate.

When the absorbing dye is incorporated in the ejection layer, its function is to absorb the incident radiation and convert this into heat, leading to more effective heating. It is preferred that the dye absorb in the infrared region. For imaging applications, it is also preferred that the dye have very low absorption in the visible region. Examples of suitable infrared absorbing dyes which can be used alone or in combination include poly(substituted)phthalocyanine compounds and metal-containing phthalocyanine compounds; cyanine dyes; squarylium dyes; chalcogenopyryloarylidene dyes; croconium dyes; metal thiolate dyes; bis(chalcogenopyrylo)polymethine dyes; oxyindolizine dyes; bis(aminoaryl)polymethine dyes; merocyanine dyes; and quinoid dyes. Infrared-absorbing materials for laser-induced thermal imaging have been disclosed, for example, by Barlow, U.S. Pat. No. 4,778,128; DeBoer, U.S. Pat. Nos. 4,942,141, 4,948,778, and 4,950,639; Kellogg, U.S. Pat. No. 5,019,549; Evans, U.S. Pat. Nos. 4,948,776 and 4,948,777; and Chapman, U.S. Pat. No. 4,952,552.

3. Ejection Layer

The ejection layer is positioned closest to the support surface. This layer, when heated, provides propulsive force to effect transfer of the imageable component to the receiver element. This is accomplished by using a polymer with a relatively low decomposition temperature.

Examples of suitable polymers include polycarbonates, such as polypropylene carbonate; substituted styrene polymers, such as polyalphamethylstyrene; polyacrylate and polymethacrylate esters, such as polymethylmethacrylate and polybutylmethacrylate; cellulosic materials such as cellulose acetate butyrate and nitrocellulose; poly(vinyl chloride); polyacetals; polyvinylidene chloride; polyurethanes; polyesters; polyorthoesters; acrylonitrile and substituted acrylonitrile polymers; maleic acid resins; and copolymers of the above. Mixtures of polymers can also be used. Additional examples of polymers having low decomposition temperatures can be found in Foley et al., U.S. Pat. No. 5,156,938. These include polymers which undergo acid-catalyzed decomposition. For these polymers it is frequently desirable to include one or more hydrogen donors with the polymer.

Preferred polymers for the ejection layer are polyacrylate and polymethacrylate esters, polycarbonates, and poly(vinyl chloride). Most preferred is poly(vinyl chloride) and nitrocellulose.

In general, it is preferred that the polymer for the ejection layer has a decomposition temperature less than 325° C., more preferably less than 275° C.

The ejection layer can contain a thermal amplification additive, as discussed above. The additive is generally present in an amount of about 0.5 to 25% by weight, based on the weight of the ejection layer.

Other materials can be present as additives in the ejection layer as long as they do not interfere with the essential function of the layer. Examples of such additives include coating aids, plasticizers, flow additives, slip agents, anti-halation agents, anti-static agents, surfactants, and others which are known to be used in the formulation of coatings.

The ejection layer generally has a thickness in the range of about 0.5 to 20 micrometers, preferably in the range of about 1 to 10 micrometers and more preferably 1 to 5 micrometers. Thicknesses greater than about 25 micrometers are generally not preferred as they result in delamination and cracking upon handling unless highly plasticized.

Although it is preferred to have a single ejection layer, it is also possible to have more than one ejection layer, and the different ejection layers can have the same or different compositions, as long as they all function as described above. The total thickness of all the ejection layers should be in the range given above.

The ejection layer(s) can be coated onto the donor support as a dispersion in a suitable solvent, however, it is preferred to coat the layer(s) from a solution. Any suitable solvent can be used as a coating solvent, as long as it does not deleteriously affect the properties of the assemblage, using conventional coating techniques or printing techniques, for example, gravure printing.

4. Heating Layer

The heating layer is deposited onto the ejection layer, further removed from the support. The function of the heating layer is to absorb the laser radiation and convert this into heat. Materials suitable for the ejection layer can be inorganic or organic and can inherently absorb the laser radiation or include additional laser-radiation absorbing compounds.

Examples of suitable inorganic materials are transition metal elements, and metallic elements of Groups IIIa, IVa, Va and VIa, their alloys with each other, and their alloys with the elements of Groups Ia and IIa. Preferred metals include Al, Cr, Sb, Ti, Bi, Ni, Zr, In, Zn, Pb and their alloys. Particularly preferred are Al, Cr, Ni and $TiO_2$.

The thickness of the heating layer is generally about 20 Angstroms to 0.1 micrometers, preferable about 30 to 100 Angstroms.

Although it is preferred to have a single heating layer, it is also possible to have more than one heating layer, and the different layers can have the same or different compositions, as long as they all function as described above. In the case of multiple heating layers it may be necessary to add laser radiation absorbing components in order to get effective heating of the layer. The total thickness of all the heating layers should be in the range given above, i.e., about 20 Angstroms to 0.1 micrometers.

The heating layer(s) can be applied using any of the well-known techniques for providing thin metal layers, such as sputtering, chemical vapor deposition and electron beam deposition.

5. Transfer Layer

The transfer layer comprises (i) a polymeric binder which is different from the binder in the ejection layer and (ii) an imageable component.

The polymeric binder for the transfer layer is a material having a decomposition temperature at least 100° C. greater than the decomposition temperature of the polymer in the ejection layer, preferably more than 150° C. greater. The binder should be film forming and coatable from solution or from a dispersion. It is preferred that the binder have a relatively low melting point to facilitate transfer. Binders having melting points less than about 250° C. are preferred. However, heat-fusible binders such as waxes should be avoided as the sole binder, as such binders may not be as durable.

It is preferred that the binder does not self-oxidize, decompose, or degrade at the temperature achieved during laser exposure so that the binder is transferred intact along with the imageable component, for improved durability. Examples of suitable binders include copolymers of styrene and (meth) acrylate esters, such as styrene/methylmethacrylate; copolymers of styrene and olefin monomers, such as styrene/ethylene/butylene; copolymers of styrene and acrylonitrile; copolymers of styrene and butadiene, such as the ABA block copolymers; fluoropolymers; copolymers of (meth)acrylate esters with ethylene and carbon monoxide; polycarbonates having higher decomposition temperatures; (meth)crylate homopolymers and copolymers; polysulfones; polyurethanes; polyesters. The monomers for the above polymers can be substituted or unsubstituted. Mixtures of polymers can also be used.

In general, it is preferred that the polymer for the transfer layer have a decomposition temperature greater than 400° C. Preferred polymers for the transfer layer are ethylene copolymers as they provide high decomposition temperatures with low melting temperatures. Most preferred are copolymers of n-butyl acrylate, ethylene and carbon monoxide.

The binder polymer generally has a concentration of about 15–50% by weight, based on the total weight of the transfer layer, preferably 30–40% by weight.

The nature of the imageable component will depend on the intended application for the assemblage. The imageable component preferably has a decomposition temperature that is greater than that of the polymeric material in the ejection layer. It is most preferred that the imageable component have a decomposition that is at least as great as the decomposition temperature of the binder polymer in the transfer layer.

For imaging applications, the imageable component will be a colorant. The colorant can be a pigment or a non-sublimable dye. It is preferred to use a pigment as the colorant for stability and for color density, and also for the high decomposition temperature. Examples of suitable inorganic pigments include carbon black and graphite. Examples of suitable organic pigments include Rubine F6B (C.I. No. Pigment 184); Cromophthal® Yellow 3G (C.I. No. Pigment Yellow 93); Hostaperm® Yellow 3G (C.I. No. Pigment Yellow 154); Monastral® Violet R (C.I. No. Pigment Violet 19); 2,9-dimethylquinacridone (C.I. No. Pigment Red 122); Indofast® Brilliant Scarlet R6300 (C.I. No. Pigment Red 123); Quindo Magenta RV 6803; Monastral® Blue G (C.I. No. Pigment Blue 15); Monastral® Blue BT 383D (C.I. No. Pigment Blue 15); Monastral® Blue G BT 284D (C.I. No. Pigment Blue 15); and Monastral® Green GT 751D (C.I. No. Pigment Green 7). Combinations of pigments and/or dyes can also be used.

In accordance with principles well known to those skilled in the art, the concentration of colorant will be chosen to achieve the optical density desired in the final image. The amount of colorant will depend on the thickness of the active coating and the absorption of the colorant. Optical densities greater than 2 at the wavelength of maximum absorption (greater than 99% of incident light absorbed) are typically required.

A dispersant is usually present when a pigment is to be transferred, in order to achieve maximum color strength, transparency and gloss. The dispersant is generally an organic polymeric compound and is used to separate the fine pigment particles and avoid flocculation and agglomeration. A wide range of dispersants is commercially available. A dispersant will be selected according to the characteristics of the pigment surface and other components in the composition as practiced by those skilled in the art. However, dispersants suitable for practicing the invention are the AB dispersants. The A segment of the dispersant adsorbs onto the surface of the pigment. The B segment extends into the solvent into which the pigment is dispersed. The B segment provides a barrier between pigment particles to counteract the attractive forces of the particles, and thus to prevent agglomeration. The B segment should have good compatibility with the solvent used. The AB dispersants of choice are generally described in "Use of AB Block Polymers as Dispersants for Non-aqueous Coating Systems", by H. C. Jakubauskas, Journal of Coating Technology, Vol. 58, No. 736, pages 71–82. Suitable AB dispersants are also disclosed in U.K. Pat. No. 1,339,930 and U.S. Pat. Nos. 3,684,771; 3,788,996; 4,070,388; 4,912,019; and 4,032,698. Conventional pigment dispersing techniques, such as ball milling, sand milling, etc., can be employed.

For lithographic applications, the imageable component is an oleophilic, ink-receptive material. The oleophilic material is usually; a film-forming polymeric material and may be the same as the binder. Examples of suitable oleophilic materials include polymers and copolymers of acrylates and methacrylates; polyolefins; polyurethanes; polyesters; polyaramids; epoxy resins; novolak resins; and combinations thereof. Preferred oleophilic materials are acrylic polymers.

The imageable component can also be a a resin capable of undergoing a hardening or curing reaction after transfer to the receiver element. The term "resin," as used herein, encompasses (1) low molecular weight monomers or oligomers capable of undergoing polymerization reactions, (2) polymers or oligomers having pendant reactive groups which are capable of reacting with each other in crosslinking reactions, (3) polymers or oligomers having pendant reactive groups which are capable of reacting with a separate crosslinking agent, and (4) combinations thereof. The resin may or may not require the presence of a curing agent for the curing reaction to occur. Curing agents include catalysts, hardening agents, photoinitiators and thermal initiators. The curing reaction can be initiated by exposure to actinic radiation, heating, or a combination of the two.

In lithographic applications, a colorant can also be present in the transfer layer. The colorant facilitates inspection of the plate after it is made. Any of the colorants discussed above can be used. The colorant can be a heat-, light-, or acid-sensitive color former.

In general, for both color proofing and lithographic printing applications, the imageable component is present in an amount of from about 35 to 95% by weight, based on the total weight of the transfer coating. For color proofing applications, the amount of imageable component is preferably 30–65% by weight; for lithographic printing applications, preferably 65–85% by weight.

Although the above discussion was limited to color proofing and lithographic printing applications, the element and process of the invention apply equally to the transfer of other types of imageable components in different applications. In general, the scope of the invention in intended to include any application in which solid material is to be applied to a receptor in a pattern. Examples of other suitable imageable components include, but are not limited to, magnetic materials, fluorescent materials, and electrically conducting materials.

The transfer layer can contain a thermal amplification additive, as discussed above. The additive is generally present in an amount of about 0.5 to 25% by weight, based on the weight of the transfer layer.

Other materials can be present as additives in the transfer layer as long as they do not interfere with the essential function of the layer. Examples of such additives include coating aids, plasticizers, flow additives, slip agents, antihalation agents, anti-static agents, surfactants, and others which are known to be used in the formulation of coatings. However, it is preferred to minimize the amount of additional materials in this layer, as they may deleteriously affect the final product after transfer. Additives may add unwanted color for color proofing applications, or they may decrease durability and print life in lithographic printing applications.

The transfer layer generally has a thickness in the range of about 0.1 to 5 micrometers, preferably in the range of about 0.1 to 2 micrometers. Thicknesses greater than about 5 micrometers are generally not preferred as they require excessive energy in order to be effectively transferred to the receiver.

Although it is preferred to have a single transfer layer, it is also possible to have more than one transfer layer, and the different layers can have the same or different compositions, as long as they all function as described above. The total thickness of all the transfer layers should be in the range given above, i.e., about 0.1 to 5 micrometers.

The transfer layer(s) can be coated onto the donor support as a dispersion in a suitable solvent, however, it is preferred to coat the layer(s) from a solution. Any suitable solvent can be used as a coating solvent, as long as it does not deleteriously affect the properties of the assemblage, using conventional coating techniques or printing techniques as used in, for example, gravure printing.

The donor element can have additional layers as well. For example, an antihalation layer can be used on the side of the support opposite the transfer layer. Materials which can be used as antihalation agents are well known in the art. Other anchoring or subbing layers can be present on either side of the support and are also well known in the art.

Receiver Element

The receiver element is the second part of the laserable assemblage, to which the imageable component is transferred. In most cases, the imageable component will not be removed from the donor element in the absence of a receiver element. Than is, exposure of the donor element alone to laser radiation does not cause material to be removed, or transferred into air. Material, i.e., binder and imageable component, is removed from the donor element only when it is exposed to laser radiation and in intimate contact with a receiver element, i.e., the donor element actually touches the receiver element This implies that, in such cases, complex transfer mechanisms are in operation.

The receiver element typically comprises a receptor support and, optionally, an image-receiving layer. The receptor support comprises a dimensionally stable sheet material. The assemblage can be imaged through the receptor support if that support is transparent. Examples of transparent films include, for example polyethylene terephthalate, polyether sulfone, a polyimide, a poly(vinyl alcohol-co-acetal), or a cellulose ester, such as cellulose acetate. Examples of opaque supports materials include, for example, polyethylene terephthalate filled with a white pigment such as titanium dioxide, ivory paper, or synthetic paper, such as Tyvek® spunbonded polyolefin. Paper supports are preferred for proofing applications. For lithographic printing applications, the support is typically a thin sheet of aluminum, such as anodized aluminum, or polyester.

Although the imageable component can be transferred directly to the receptor support, the receiver element typically has an additional receiving layer on one surface thereof. For image formation applications, the receiving layer can be a coating of, for example, a polycarbonate, a polyurethane, a polyester, poly(vinyl chloride), styrene/acrylonitrile copolymer, poly(caprolactone), and mixtures thereof. This image receiving layer can be present in any amount effective for the intended purpose. In general, good results have been obtained at coating weights of 1 to 5 g/m$^2$. For lithographic applications, typically the aluminum sheet is treated to form a layer of anodized aluminum on the surface as a receptor layer. Such treatments are well known in the lithographic art.

It is also possible that the receiver element not be the final intended support for the imageable component. The receiver element can be an intermediate element and the laser imaging step can be followed by one or more transfer steps by which the imageable component is transferred to the final support. This is most likely to be the case for multicolor proofing applications in which the multicolor image is built up on the receiver element and then transferred to the permanent paper support.

Process Steps

1. Exposure

The first step in the process of the invention is imagewise exposing the laserable assemblage to laser radiation. The laserable assemblage comprises the donor element and the receiver element, described above.

The assemblage is prepared by placing the donor element in intimate contact with the receiver element such that the transfer coating of the donor element actually touches the receiver element or the receiving layer on the receiver element. Thus, the two elements actually touch one another.

Vacuum or pressure can be used to hold the two elements together. Alternatively, the donor and receiver elements can be taped together and taped to the imaging apparatus, or a pin/clamping system can be used. The laserable assemblage can be conveniently mounted on a drum to facilitate laser imaging.

Various types of lasers can be used to expose the laserable assemblage. The laser is preferably one emitting in the infrared, near-infrared or visible region. Particularly advantageous are diode lasers emitting in the region of 750 to 870 nm which offer substantial advantage in terms of their small size, low cost, stability, reliability, ruggedness and ease of modulation. Diode lasers emitting in the range of 800 to 850 nm are most preferred. Such lasers are available from, for example, Spectra Diode Laboratories (San Jose, Calif.).

The exposure can take place through the support of the donor element or through the receiver element, provided that these are substantially transparent to the laser radiation. In most cases, the donor support will be a film which is transparent to infrared radiation and the exposure is conveniently carried out through the support. However, if the receiver element is substantially transparent to infrared radiation, the process of the invention can also be carried out by imagewise exposing the receiver element to infrared laser radiation.

The laserable assemblage is exposed imagewise so that material, i.e., binder and imageable component, is transferred to the receiver element in a pattern. The pattern itself can be, for example, in the form of dots or linework generated by a computer, in a form obtained by scanning artwork to be copied, in the form of a digitized image taken from original artwork, or a combination of any of these forms which can be electronically combined on a computer prior to laser exposure. The laser beam and the laserable assemblage are in constant motion with respect of each other, such that each minute area of the assemblage, i.e., pixel, is individually addressed by the laser. This is generally accomplished by mounting the laserable assemblage on a rotatable drum. A flat bed recorder can also be used.

2. Separation

The next step in the process of the invention is separating the donor element from the receiver element. Usually this is done by simply peeling the two elements apart. This generally requires very little peel force, and is accomplished by simply separating the donor support from the receiver element. This can be done using any conventional separation techniques and can be manual or automatic without operator intervention.

Throughout the above discussions, the intended product has been the receiver element, after laser exposure, onto which the imageable component has been transferred in a pattern. However, it is also possible for the intended product to be the donor element after laser exposure. If the donor support is transparent, the donor element can be used as a phototool for conventional analog exposure of photosensitive materials, e.g., photoresists, photopolymer printing plates, photosensitive proofing materials and the like. For phototool applications, it is important to maximize the density difference between "clear," i.e., laser exposed, and "opaque," i.e., unexposed areas of the donor element. Thus the materials used in the donor element must be tailored to fit this application.

EXAMPLES

| Glossary | |
|---|---|
| Thermal Amplification Additives: | |
| ABA | p-azidobenzoic acid |
| AmbiC | ammonium bicarbonate |
| AmC | ammonium carbonate |
| AmdiCh | ammonium dichromate |
| DiAFB | 4-diazo-N,N'-diethylaniline fluoroborate |
| NaC | sodium carbonate |
| SrO | strontium oxide |
| SrPO | strontium peroxide |
| Other Materials: | |
| Black | black pigment, Regal 660 (Cabot) |
| CyHex | cyclohexanone |
| Dispersant | AB dispersant |
| DPP | diphenyl phosphate |
| EP4043 | 10% CO, 30% n-butylacrylate and 60% ethylene copolymyer Td = 457° C. (DuPont) |
| MC | methylene chloride |
| MEK | methyl ethyl ketone |
| PVC | poly(vinyl chloride) (Aldrich) Td = 282° C., Td2 = 465° C. TIC-5C |

Procedure

The laser imaging apparatus was a Creo Plotter (Creo Corp., Vancouver, BC) with 32 infrared lasers emitting at 830 nm, with a 3 microseconds pulse width. The laser fluence was calculated based on laser power and drum speed.

The receiver element, paper, was placed on the drum of the laser imaging apparatus. The donor element was then placed on top of the receiver element such that the transfer layer of the donor element was adjacent to the receiving side of the receiver element. A vacuum was then applied.

To determine sensitivity of the film, stripes of full burn pattern were obtained and drum speeds varied from 100 to 400 rpm in 25 rpm increments. The density of the image transferred onto paper was measured using a MacBeth densitometer in a reflectance mode for each of the stripes written at the different drum speeds. The sensitivity was the minimum laser power required for transfer of material to occur, with a density greater than 1.

Examples 1–6

These examples illustrate the effect of thermal amplification additives on film sensitivity when added to the transfer layer of a two-layer donor element.

The samples consisted of a support of Mylar® 200 D polyester film (E. I. du Pont de Nemours and Company, Wilmington, Del.) onto which a 60 Å coating of chromium had been sputtered, to form the heating layer. The sputtering was done by Flex Products (Santa Rosa, Calif.) using an argon atmosphere and 50 mTorr. The metal thickness was monitored in situ using a quartz crystal. After deposition, thicknesses were confirmed by measuring reflection and transmission of the films.

The transfer layer was bar coated by hand over the heating layer to a dry thickness of about one micrometer. The coatings used for the transfer layers had the compositions given below, given in grams.

| | |
|---|---|
| K1 dispersion: | |
| black | 70 |
| dispersant | 30 |
| MEK/CyHex (60/40) | 300 |
| pigment/dispersant/% solids | 70/30/25 |
| Transfer coating (TC0) | |
| EP4043, 6% solution in MC | 39.58 |
| DPP | 0.46 |
| K1 | 9.5 |
| Transfer coating 1 (TC1) | |
| EP4043, 6% solution in MC | 39.58 |
| DPP | 0.46 |
| DiAFB | 0.05 |
| K1 | 9.5 |
| Transfer coating 2 (TC2) | |
| EP4043, 6% solution in MC | 39.58 |
| DPP | 0.46 |
| DiAFB | 0.125 |
| K1 | 9.5 |
| Transfer coating 3 (TC3) | |
| EP4043, 6% solution in MC | 39.58 |
| DPP | 0.46 |
| DiAFB | 0.25 |
| K1 | 9.5 |
| Transfer coating 4 (TC4) | |
| EP4043, 6% solution in MC | 39.58 |
| DPP | 0.46 |
| DiAFB | 0.59 |
| K1 | 9.5 |
| Transfer coating 5 (TC5) | |
| EP4043, 6% solution in MC | 39.58 |
| DPP | 0.46 |
| DiAFB | 0.63 |
| K1 | 9.5 |
| Transfer coating 6 (TC6) | |
| EP4043, 6% solution in MC | 39.58 |
| DPP | 0.46 |
| DiAFB | 0.678 |
| K1 | 9.5 |

The sensitivities of the films were measured using the procedure described above. The results are given in Table 1 below and clearly demonstrate the increased sensitivity of the films having the thermal amplification additive in the transfer layer.

Examples 7–12

These examples illustrate the increased sensitivity using a different thermal amplification additive, p-azidobenzoic acid, in the transfer layer.

The procedure of Examples 1–6 was repeated using the transfer layer compositions given below, given in grams.

| | |
|---|---|
| Transfer coating 7 (TC7) | |
| EP4043, 6% solution in MC | 36.98 |
| DPP | 0.5 |
| ABA | 0.0625 |
| K1 | 8.875 |
| MEK | 3.584 |
| Transfer coating 8 (TC8) | |
| EP4043, 6% solution in MC | 36.46 |
| DPP | 0.5 |
| ABA | 0.125 |
| K1 | 8.75 |
| MEK | 4.167 |
| Transfer coating 9 (TC9) | |
| EP4043, 6% solution in MC | 35.41 |
| DPP | 0.5 |
| ABA | 0.25 |
| K1 | 8.5 |
| MEK | 5.334 |
| Transfer coating 10 (TC10) | |
| EP4043, 6% solution in MC | 33.33 |
| DPP | 0.5 |
| ABA | 0.5 |
| K1 | 8.0 |
| MEK | 7.67 |
| Transfer coating 11 (TC11) | |
| EP4043, 6% solution in MC | 31.25 |
| DPP | 0.5 |
| ABA | 0.75 |
| K1 | 7.5 |
| MEK | 10.0 |
| Transfer coating 12 (TC12) | |
| EP4043, 6% solution in MC | 29.166 |
| DPP | 0.5 |
| ABA | 1.0 |
| K1 | 7.0 |
| MEK | 12.33 |

The sensitivities of the films are given in Table 2 below.

TABLE 1

| | | | Density | | | | | | |
|---|---|---|---|---|---|---|---|---|---|
| RPM | TAvF | PF | control (0) | TC1 (0.95) | TC2 (2.4) | TC3 (4.6) | TC4 (10.2) | TC5 (10.8) | TC6 (11.5) |
| 100 | 726 | 575 | 1.29 | 1.31 | 1.31 | 1.32 | 1.22 | 1.24 | 1.4 |
| 125 | 616 | 458 | 1.09 | 1.31 | 1.31 | 1.36 | 1.21 | 1.31 | 1.33 |
| 150 | 513 | 382 | 0.83 | 1.21 | 1.30 | 1.38 | 1.22 | 1.3 | 1.3 |
| 175 | 440 | 327 | 0.24 | 0.96 | 0.99 | 0.98 | 1.19 | 1.29 | 1.36 |
| 200 | 385 | 286 | 0.06 | 0.41 | 0.58 | 0.99 | 1.04 | 1.09 | 1.32 |
| 250 | 308 | 229 | 0 | 0.02 | 0.1 | 0.08 | 0.31 | 0.4 | 1.00 |

( ) = weight percent diAFB
RPM = drum speed in revolutions per minute
TAvF = total average fluence in $mJ/cm^2$
PF = peak fluence in $mJ/cm^2$

TABLE 2

| | | | Density | | | | | | |
|---|---|---|---|---|---|---|---|---|---|
| RPM | TAvF | PF | control (0) | TC7 (1.25) | TC8 (2.5) | TC9 (5.0) | TC10 (10) | TC11 (15) | TC12 (20) |
| 100 | 726 | 572 | 1.34 | 1.27 | 1.30 | 1.28 | 1.24 | 1.34 | 1.34 |
| 125 | 616 | 458 | 1.33 | 1.30 | 1.30 | 1.31 | 1.26 | 1.27 | 1.27 |
| 150 | 513 | 382 | 1.22 | 1.35 | 1.26 | 1.33 | 1.27 | 1.29 | 1.29 |
| 175 | 440 | 327 | 0.81 | 1.33 | 1.26 | 1.34 | 1.25 | 1.29 | 1.29 |
| 200 | 385 | 286 | 0.26 | 1.26 | 1.05 | 1.19 | 1.21 | 1.30 | 1.30 |
| 225 | 342 | 254 | | 0.78 | 0.57 | 0.98 | 1.04 | 1.15 | 1.10 |
| 250 | 308 | 229 | 0 | 0.45 | 0.4 | 0.64 | 0.69 | 0.97 | 1.00 |
| 275 | 280 | 208 | | 0.22 | 0.3 | 0.54 | 0.56 | 0.64 | 0.88 |

( ) = weight percent ABA
RPM = drum speed in revolutions per minute
TAvF = total average fluence in mJ/cm$^2$
PF = peak fluence in mJ/cm$^2$

Examples 12–22

These examples illustrate the effect of the thermal amplification additive when added to the transfer layer of a three-layer donor system.

The support was Mylar® 200 D. The ejection layer, having the composition below, was coated using an automatic coater to a dry thickness of 50 microns. A 1 mil (25 micron) polyethylene coversheet was laminated to the ejection layer during coating to protect the layer from scratching and dust. A 60 Å thick chromium heating layer was sputtered onto each of the ejection layers as described in Examples 1–6.

A transfer layer was coated over the heating layer in all the samples. The transfer layer was bar coated by hand to a dry thickness of about one micron. The coatings used for the transfer layers had the compositions given in below, in grams.

| | |
|---|---|
| Ejection layer | |
| PVC | 1500 |
| DPP | 150 |
| MEK | 9000 |
| CYHEX | 6000 |
| K1 dispersion: | |
| black | 70 |
| dispersant | 30 |
| MEK/CyHex (60/40) | 300 |
| pigment/dispersant/% solids | 70/30/25 |
| K2 dispersion: | |
| black | 75 |
| dispersant | 25 |
| MEK/CyHex (60/40) | 300 |
| pigment/dispersant/% solids | 75/25/25 |
| K3 dispersion: | |
| black | 80 |
| dispersant | 20 |
| MEK/CyHex (60/40) | 300 |
| pigment/dispersant/% solids | 80/20/25 |
| K4 dispersion: | |
| black | 85 |
| dispersant | 15 |
| MEK/CyHex (60/40) | 300 |
| pigment/dispersant/% solids | 85/15/25 |
| Transfer coating 13 (TC13) | |
| EP4043, 6% solution in MC | 25.0 |
| DPP | 0.5 |
| diAFB | 0.75 |

-continued

| | |
|---|---|
| K1 | 9.0 |
| MEK | 1.06 |
| CyHex | 0.78 |
| Transfer coating 14 (TC14) | |
| EP4043, 6% solution in MC | 26.87 |
| DPP | 0.5 |
| diAFB | 0.75 |
| K2 | 9.0 |
| MEK | 1.00 |
| CyHex | 0.78 |
| Transfer coating 15 (TC15) | |
| EP4043, 6% solution in MC | 28.33 |
| DPP | 0.5 |
| diAFB | 0.75 |
| K3 | 9.0 |
| MEK | 1.00 |
| CyHex | 0.78 |
| Transfer coating 16 (TC16) | |
| EP4043, 6% solution in MC | 30.66 |
| DPP | 0.5 |
| diAFB | 0.75 |
| K4 | 9.0 |
| MEK | 1.06 |
| CyHex | 0.78 |
| Transfer coating 17 (TC17) | |
| EP4043, 6% solution in MC | 25.0 |
| DPP | 0.5 |
| diAFB | 0.75 |
| K1 | 9.0 |
| MEK | 1.00 |
| CyHex | 0.78 |
| Transfer coating 18 (TC18) | |
| EP4043, 6% solution in MC | 16.66 |
| DPP | 0.5 |
| diAFB | 0.75 |
| K1 | 11.0 |
| MEK | 4.87 |
| CyHex | 3.25 |
| Transfer coating 19 (TC19) | |
| EP4043, 6% solution in MC | 8.33 |
| DPP | 0.5 |
| diAFB | 0.75 |
| K1 | 13.0 |
| MEK | 8.67 |
| CyHex | 5.78 |
| Transfer coating 20 (TC20) | |
| EP4043, 6% solution in MC | — |
| DPP | 0.5 |
| diAFB | 0.75 |
| K1 | 15.0 |

-continued

| | |
|---|---|
| MEK | 12.46 |
| CyHex | 8.31 |
| Transfer coating 21 (TC21) | |
| EP4043, 6% solution in MC | 25.0 |
| DPP | 0.25 |
| diAFB | 0.75 |
| K1 | 10.0 |
| MEK | 0.618 |
| CyHex | 0.412 |
| Transfer coating 22 (TC22) | |
| EP4043, 6% solution in MC | 25.0 |
| DPP | — |
| diAFB | 0.75 |
| K1 | 9.0 |
| MEK | 0.168 |
| CyHex | 0.112 |

The sensitivities of the films are given in Table 3 below. It can be seen from Examples 17–20 and 21–22 that the durability of the transferred image decreases as the amount of binder is decreased in the transfer layer and as the amount of plasticizer is decreased in the transfer layer.

TABLE 3

| | | Density | | | | | | | | | |
|---|---|---|---|---|---|---|---|---|---|---|---|
| RPM | TAvF | TC13 | TC14 | TC15 | TC16 | TC17 | TC18 | TC19 | TC20 | TC21 | TC22 |
| 100 | 726 | 1.35 | 1.36 | 1.36 | 1.33 | 1.28 | 1.30 | 1.34 | 1.39 | 1.28 | 1.26 |
| 125 | 616 | 1.31 | 1.36 | 1.38 | 1.40 | 1.20 | 1.30 | 1.27 | 1.37 | 1.28 | 1.29 |
| 150 | 513 | 1.30 | 1.39 | 1.43 | 1.45 | 1.18 | 1.28 | 1.29 | 1.40 | 1.27 | 1.29 |
| 175 | 440 | 1.31 | 1.40 | 1.41 | 1.45 | 1.21 | 1.08 | 1.25 | 1.34 | 1.24 | 1.34 |
| 200 | 385 | 1.30 | 1.42 | 1.45 | 1.48 | 1.15 | 1.10 | 1.19 | 1.19 | 1.16 | 1.12 |
| 225 | 342 | 1.30 | 1.47 | 1.42 | 1.50 | 1.09 | 0.92 | 1.04 | 0.85 | 1.16 | 1.16 |
| 250 | 308 | 1.18 | 1.48 | 1.42 | 1.50 | 1.01 | 0.62 | 0.64 | 0.76 | 1.03 | 1.16 |
| 275 | 280 | 1.03 | 1.30 | 1.30 | 1.32 | 0.87 | 0.52 | 0.56 | 0.76 | 0.42 | 1.05 |
| Durability | | Y | Y | Y | Y | Y | N | N | N | N | N |

RPM = drum speed in revolutions per minute
TAvF = total average fluence in mJ/cm$^2$
pitch = 5.8 microns
Y = means that the film is durable, glossy and scratch resistant
N = means that the film is easily scratchable and exhibits powdery appearance. The degree of scratchability increases with decreasing concentration of the high decomposition temperature binder.

Examples 23–30

These examples illustrate the increase in sensitivity in a three layer system using different thermal amplification additives in the transfer layer.

The procedure of Examples 13–22 was repeated using a donor element have a heating layer of 85 Å of aluminum. In order to achieve uniform dispersion, the thermal amplification additives (with the exception of diAFB and ABA) were cryo-ground to submicron particle size. The transfer coating had a thickness of 0.8 microns and had the composition given below, in grams.

Transfer coating

| | |
|---|---|
| EP4043, 6% solution in MC | 39.58 |
| DPP | 0.46 |
| Thermal amplification additive | 0.63 |
| K1 | 9.5 |

The sensitivities of the films with different thermal amplification additives are provided in Table 4 below.

TABLE 4

| Example | Additive | RPM | TAvF | Td (°C.) |
|---|---|---|---|---|
| control | none | 150 | 528 | |
| Ex. 23 | DiAFB | 325 | 244 | 136.3 |
| Ex. 24 | AmdiCh | 325 | 244 | 171 |
| Ex. 25 | AmC | 300 | 264 | 112 |
| Ex. 26 | NaC | 275 | 288 | 81.8 |
| Ex. 27 | AmbiC | 275 | 288 | 130 |
| Ex. 28 | SrPO | 250 | 317 | 70.6 |
| Ex. 29 | SrO | 250 | 317 | 94.9 |
| Ex. 30 | ABA | 275 | 288 | 200.8 |

RPM = drum speed
TAvF = total average fluence in mJ/cm$^2$
Td = decomposition temperature of the thermal amplification additive

Examples 31–46

These examples illustrate the use of thermal amplification additives in both the ejection layer and the transfer layer. Both an infrared dye and a decomposable compound were used as the thermal amplification additive in the ejection layer.

The support was Mylar® 200 D. The ejection layer, having the composition below, was bar coated by hand from MEK/CyHex (30/20) to a dry thickness of either 0.5 microns or 1.0 microns, as indicated below. The ejection layer contained 10% DPP, 1–15% thermal amplification additive, and the remaining 75–89% PVC, based on the total weight of solids of the layer.

An 80 Å thick aluminum heating layer was sputtered onto each of the ejection layers using a Denton 600 (Denton, N.J.) unit. The metal thickness was monitored in situ using a quartz crystal. After deposition, thicknesses were confirmed by measuring reflection and trasmission of the films.

A transfer layer with the TC6 composition was coated over the heating layer in all the samples. The transfer layer was bar coated by hand to a dry thickness of about one micron.

The sensitivities of the donor films were determined as the highest drum speed at which total or partial transfer occured in the exposed areas, and are provided in Table 5 below.

TABLE 5

| Sample No. | Additive | Ejection Layer Concentration (%) | Thickness (microns) | Drum Speed (8.0μ pitch) | TAvF (mJ/cm²) |
|---|---|---|---|---|---|
| 31A | none | — | 0.5 | 150 | 350 |
| 31B | none | — | 1.0 | 150 | 350 |
| 32 | Tic-5c | 1% | 0.5 | 225 | 233 |
| 33 | | 2% | | 275 | 191 |
| 34 | | 5% | | 275 | 191 |
| 35 | | 10% | | 250 | 210 |
| 36 | | 2.5% | 1.0 | 200 | 263 |
| 37 | | 5% | | 175 | 300 |
| 38 | | 10% | | 175 | 300 |
| 39 | | 15% | | 175 | 300 |
| 40 | dAFB | 1% | 0.5 | 225 | 233 |
| 41 | | 2% | | 250 | 210 |
| 42 | | 5% | | 200 | 263 |
| 43 | | 2.5% | 1.0 | 225 | 233 |
| 44 | | 5% | | 175 | 300 |
| 45 | | 10% | | 225 | 233 |
| 46 | | 15% | | 225 | 233 |

Examples 47–59

These examples illustrate the effect of the thickness of the heating layer on film sensitivity for three-layer donor films having thermal amplification additives in both the ejection layer and the transfer layer.

The ejection layer had the composition of Example 33 and was gravure coated in a direct gravure configuration. The viscosity of the solution was 80 cp and a 50 gravure roll was used. The thickness of the layer was either 1.0 or 0.5 microns as indicated below.

The heating layer was aluminum sputtered on with the Denton 600 unit to the thickness given below. The metal thickness was monitored in situ using a quartz crystal. After deposition, thicknesses were confirmed by measuring reflection and transmission of the films.

The transfer layers with the TC6 composition were coated over the heating layers in all the samples. The transfer layer was bar coated by hand to a dry thickness of one micron.

The sensitivities of the donor films were determined as the highest drum speed at which total or partial transfer occured in the exposed areas, and are given in Table 6 below.

TABLE 6

| # | d (μ) | TA1 | RPM | TAvF | p (μ) |
|---|---|---|---|---|---|
| 47 | 1 | 0.034 | 175 | 300 | 8.0 |
| 48 | | 0.103 | 200 | 263 | |
| 49 | | 0.198 | 225 | 233 | |
| 50 | | 0.290 | 225 | 233 | |
| 51 | | 0.412 | 200 | 263 | |
| 52 | | 0.593 | 250 | 210 | |
| 53 | 0.5 | 0.405 | 275 | 233 | 5.8 |
| 54 | | 0.508 | 250 | 317 | |
| 55 | | 0.505 | 250 | 317 | |
| 56 | | 0.516 | 325 | 244 | |
| 57 | | 0.675 | 275 | 288 | |
| 58 | | 0.7 | 325 | 244 | |
| 59 | | 0.805 | 275 | 288 | |

TAI = transmission of Al heating layer
RPM = drum speed in revolutions per minute
d (μ) thickness of ejection layer
TAvF = total average fluence in mJ//cm²
p (μ) diameter of focus laser beam at focal plane, in microns.

What is claimed is:

1. A donor element for use in a laser-induced thermal transfer process, said element comprising a support bearing on a first surface thereof, in the order listed:

(a) at least one ejection layer comprising a first polymer having a decomposition temperature $T_1$° C.;

(b) at least one heating layer;

(c) at least one transfer layer comprising (i) a second polymer having a decomposition temperature $T_2$° C. and (ii) an imageable component:

wherein $T_2 \geqq (T_1°C.+100)$, and further wherein a thermal amplification additive is present in at least one of layers (a) and (c).

2. The element of claim 1 wherein the first polymer has a decomposition temperature less than 325° C. and is selected from the group consisting of alkylsubstitued styrene polymers, polyacrylate esters, polymethacrylate esters, cellulose acetate butyrate, nitrocellulose, poly (vinyl chloride), polyacetals, polyvinylidene chloride, polyurethanes, polyesters, polyorthoesters, acrylonitrile, maleic acid resins, polycarbonates and copolymers and mixtures thereof.

3. The element of claim 1 wherein the heating layer comprises a thin metal layer selected from the group consisting of aluminum, nickel, chromium, zirconium and titanium oxide.

4. The element of claim 1 wherein the second polymer has a decomposition temperature greater than 400° C. and is selected from the group consisting of copolymers of acrylate esters, ethylene and carbon monoxide and copolymers of methacrylate estes, ethylene and carbon monoxide.

5. The element of claim 1 wherein the first polymer is selected from the group consisting of poly(vinyl chloride) and nitrocellulose, the heating layer comprises a thin layer of metal selected from the group consisting of nickel and chromium, the second polymer is selected from the group consisting of copolymers of polystyrene and copolymers of n-butylacrylate, ethylene and carbon monoxide, and the thermal amplification additive is 4-diazo-N,N'-diethylaniline fluoroborate.

6. The element of claim 1 wherein (a) the ejection layer has a thickness in the range of about 0.5 to 20 micrometers, (b) The heating layer has a thickness in the range of about 20 Å to 0.1 μm, and (c) the transfer layer has a thickness in the range of about 0.1 to 50 micrometers.

7. A donor element for use in a laser-induced thermal transfer process, said element consisting essentially of support bearing on a first surface thereof, in the order listed:

(a) at least one ejection layer containing a dye absorbing at the laser wavelength;

(b) at least one transfer layer comprising a binder and an imageable component;

wherein a thermal amplification additive is present in layer (b).

8. The element of claim 1 or 7 wherein the thermal amplification additive is selected from the group consisting of diazo alkyls and diazonium compounds, azido compounds, ammonium salts, oxides which decompose to form oxygen, carbonates, carbonates, peroxides, and mixtures thereof.

9. The element of claim 1 or 2 wherein the imageable component is a pigment.

10. A laser-induced, thermal transfer process which comprises:

(1) imagewise exposing to laser radiation a laserable assemblage comprising:

(A) a donor element comprising a support bearing on a first surface thereof, in the order listed:

(a) at least one ejection layer comprising a first polymer having a decomposition temperature $T_1$° C.;

(b) at least one heating layer;

(c) at least one transfer layer comprising (i) a second polymer having a decomposition temperature $T_2$° C. and (ii) an imageable component;

wherein $T_2$°C.≧($T_1$°C.+100), and further wherein a thermal amplification additive is present in at least one of layers (a) and (c);

(B) a receiver element in intimate contact with the first surface of the donor element.

11. The process of claim 10 wherein the first polymer has a decomposition temperature less than 325° C. and is selected from the group consisting of alkylsubstitued styrene polymers, polyacrylate esters, polymethacrylate esters, cellulose acetate butyrate, nitrocellulose, poly vinylchloride, polyacetals, polyvinylidene chloride, polyurethanes, polyesters, polyorthoesters, acrylonitrile, maleic acid resins, polycarbonates and copolymers and mixtures thereof.

12. The process of claim 10 wherein the heating layer comprises a thin metal layer selected from the group consisting of aluminum, nickel, chromium, zirconium and titanium oxide.

13. The process of claim 10 wherein the second polymer has a decomposition temperature greater than 400° C. and is selected from the group consisting of copolymers of acrylate esters, ethylene and carbon monoxide and copolymers of methacrylate esters, ethylene and carbon monoxide.

14. The process of claim 10 wherein the first polymer is selected from the group consisting of poly(vinyl chloride) and nitrocellulose, the heating layer comprises a thin layer of metal selected from the group consisting of Al, nickel, and chromium, the second polymer is selected from the group consisting of copolymers of polystyrene and copolymers of n-butylacrylate, ethylene and carbon monoxide; and the thermal amplification additive is selected from the group consisting of 4-diazo-N,N'-diethylaniline fluoroborate and azo-bis-isobutyronitrile.

15. The process of claim 10 wherein (a) the ejection layer has a thickness in the range of about 0.5 to 20 micrometers, (b) The heating layer has a thickness in the range of about 20 Å to 0.1 μm, and (c) the transfer layer has a thickness in the range of about 0.1 to 50 micrometers.

16. A laser-induced thermal transfer process which comprises:

(1) imagewise exposing to laser radiation a laserable assemblage comprising:

(A) a donor element consisting essentially of a support bearing on a first surface thereof, in the order listed:

(a) at least one ejection layer containing a dye absorbing at the laser wavelength;

(b) at least one transfer layer comprising a binder; an imageable component; and a thermal amplification additive; and (B) a receiver element in intimate contact with the first surface of the donor element; and (2) separating the donor element from the receiver element.

17. The process of claim 16 wherein the binder has a decomposition temperature greater than 400° C. and is selected from the group consisting of copolymers of acrylate esters, ethylene and carbon monoxide and copolymers of methacrylate esters, ethylene and carbon monoxide.

18. The process of claim 10 or 16 wherein the thermal amplification additive is selected from the group consisting of diazo alkyl and diazonium compounds, azido compounds, ammonium salts, oxides which decompose to form oxygen, carbonates, carbonates, peroxides, and mixtures thereof.

19. The process of claim 16 wherein (a) the ejection layer has a thickness in the range of about 0.5 to 5 micrometers; and (b) the transfer layer has a thickness in the range of about 0.1 to 50 micrometers.

20. The process of claim 10 or 16 wherein the imageable component is a pigment.

* * * * *